United States Patent [19]

Amick et al.

[11] 4,357,772

[45] Nov. 9, 1982

[54] MODULAR SIGN SUPPORT

[76] Inventors: Edward W. Amick, 1151 Harborview Rd., Charlotte Harbour, Fla. 33950; Paul W. Pelley, 212 Great Neck St., Port Charlotte, Fla. 33952

[21] Appl. No.: 149,174

[22] Filed: May 12, 1980

[51] Int. Cl.[3] ..... G09F 7/00; G09F 15/00

[52] U.S. Cl. ..... 40/605; 40/606; 248/159

[58] Field of Search ..... 40/605, 606, 607, 610, 40/617, 584, 612; 248/159

[56] References Cited

U.S. PATENT DOCUMENTS

| | | | |
|---|---|---|---|
| 208,974 | 10/1878 | Gulden | 40/617 |
| 1,788,096 | 1/1931 | Friedemann | 248/159 |
| 1,824,578 | 9/1931 | Thake | 40/607 |
| 2,409,076 | 10/1946 | Steinberger et al. | 40/607 |
| 2,802,291 | 8/1957 | Bach et al. | 40/606 |
| 2,865,124 | 12/1958 | Mortellito | 40/605 |
| 3,631,640 | 1/1972 | Dunne | 248/159 |
| 3,829,999 | 8/1974 | Berustein | 40/605 |
| 4,249,715 | 2/1981 | Repp | 40/607 |
| 4,250,647 | 2/1981 | Woodard | 40/617 |
| 4,258,494 | 3/1981 | Borque | 40/607 |

*Primary Examiner*—Gene Mancene
*Assistant Examiner*—Michael J. Foycik, Jr.
*Attorney, Agent, or Firm*—Alfred E. Wilson

[57] ABSTRACT

A modular sign support is particularly adapted for supporting a real estate sign in the front yard area of a structure, as well as for supporting a name plate, electric lamp, mail box or the like in front of a private residence, business office or the like. The modular sign support includes a main vertical post or standard with a pointed bottom spike portion which is formed as a plurality of plastic modules, formed with socket and tenon connection, a top cross arm is similarly connected to the top of the post and includes at least one elongated arm portion with a pair of downwardly extending spaced apart tabs with holes therethrough to receive connector means to a display panel or sign.

1 Claim, 6 Drawing Figures

MODULAR SIGN SUPPORT

BACKGROUND OF THE PRESENT INVENTION

Conventional signs displayed in front of property that is for sale or rent, for example, are made of relatively heavy wooden posts and are quite heavy and awkward to handle because of their weight and overall size. Therefore, it is customary in many areas, with the wood signs to pay a sign installer to place them on a listed property.

Therefore, one of the principal objects of the present invention is to provide a modular sign support structure in which the modules are formed of any of a variety of suitable plastic materials such as polyethelyne, and in which the various modules are very light in weight and are of moderate, easy to handle and transport sizes.

A further object of the invention is to provide the various modules with socket and tenon connector means for easy assembly thereof on the erection site. If desired, a suitable plastic adhesive may be applied to the tenons for permanent connection of the modules.

Yet another object of the invention is to provide the modules with a selected color or colors impregnated in the plastic material, thereby eliminating the necessary painting operation to wooden posts, while providing a more attractive and durable structure which can be given to a property buyer, for example, to display a name plate, support a mail box or fitted with an electric lamp, if desired.

DETAILED DESCRIPTION OF THE INVENTION

Figure 1:
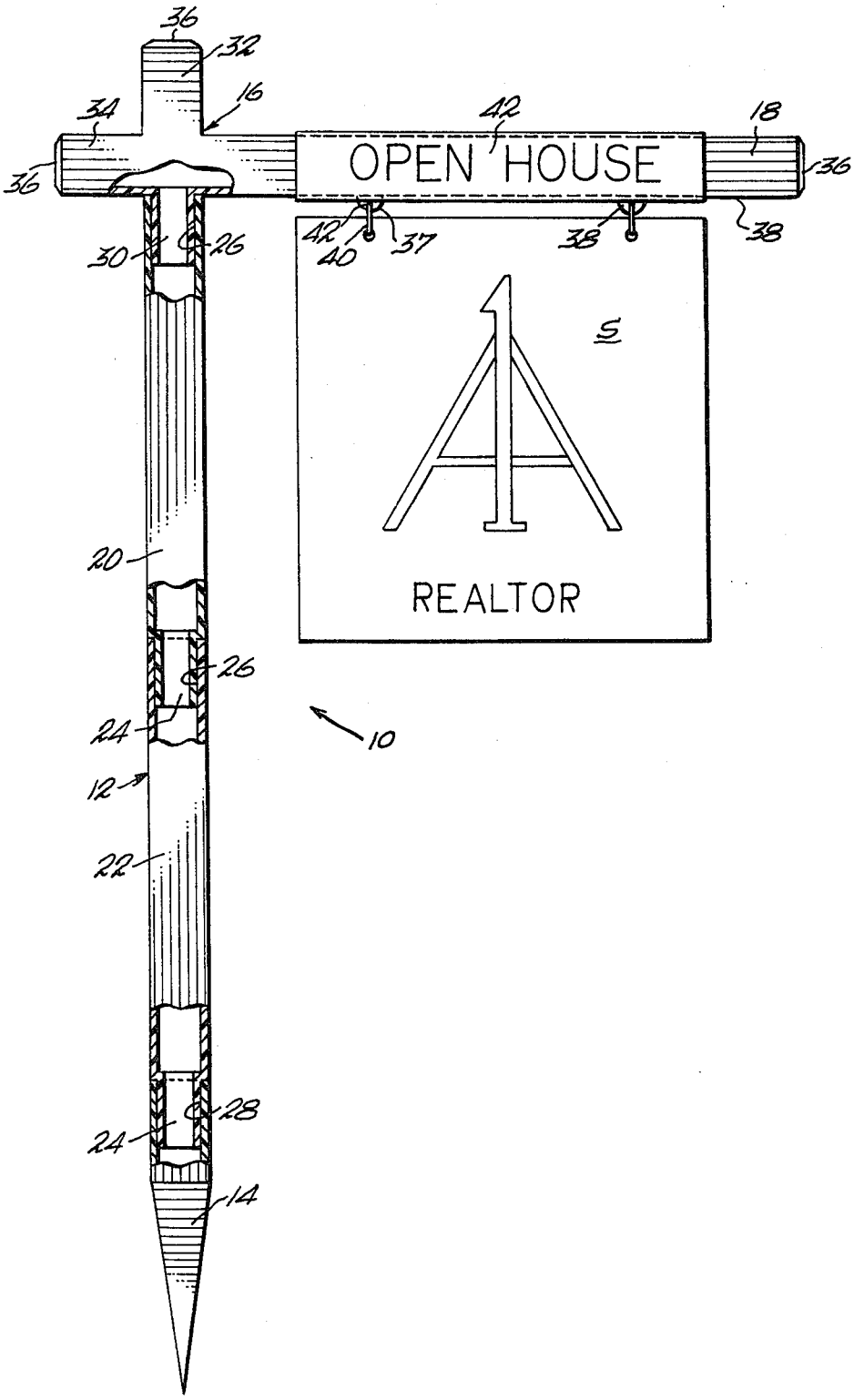
FIG. 1 is a front elevational view of one preferred form of modular sign support of the present invention.
Figure 2:
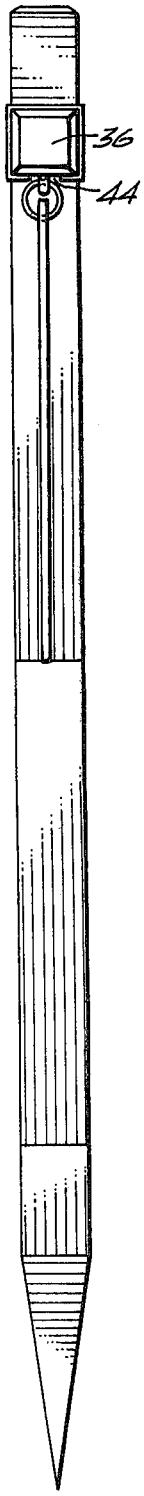
FIG. 2 is an end elevational view of FIG. 1.

With reference to the drawings, and particularly to FIGS. 1 and 2, one preferred form of the instant invention, indicated generally at 10, includes a post or atandard portion 12 including a bottom pointed spike 14, for penetration into the ground, and a top cross arm portion designated generally at 16. Top cross arm 16 includes one laterally elongated arm portion 18.

With particular reference to FIG. 1, the post 12 includes two like modules 20, 22 connecting between the spike portion 14 and cross arm portion 16. Each of the modules 20, 22 include a tenon portion 24 on a first end which is cross sectionally reduced in size relative to the main body portion thereof, and defines a socket 26 in a second end. The spike 14 provides an upper end socket 28 and cross arm 16 includes a downwardly vertically extending tenon 30 in vertical alignment with a relatively short arm portion 32, extending upwardly of horizontally aligned long arm 18 and a second short arm portion 34. All of the arms 18, 32 and 34 have integral extended end closures 36.

With further reference to FIGS. 1 and 2 the long arm 18 includes a pair of tabs 37, 38 integrally molded therewith along a bottom face 38 in a predetermined spaced relation to receive conventional sign attachment means, such as rings 40, through tab holes 42.

A sign, such as the realtor sign S, is conventionally suspended from tabs 37, 38 by means of rings 40. All of the modules of the structure 10 are generally rectangular in cross section and are molded by any applicable method of any of a variety of suitable plastic material such as polyethelyne.

A generally tubular secondary sign such as the "Open House" sign illustrated at 42 is slidably engagable over long arm 18, to a position above the Realtor sign S. To this end, a slot 44, FIG. 2, is longitudinally provided in a bottom wall of sign 42 to clear the tabs 37, 38.

Figure 3:
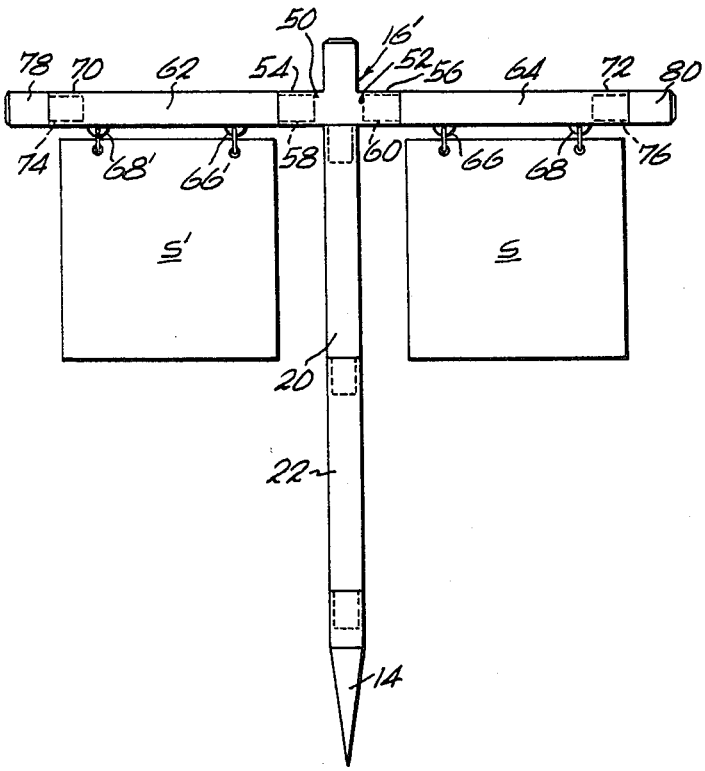
FIG. 3 is a front elevational view of a first modified form of the invention.

In the modification of FIG. 3, the top cross arm member 16' includes a pair of oppositely laterally extending short arms 50, 52 with open socket ends 54, 56 for reception of tenons 58, 60 of oppositely outwardly extending arm modules 62, 64, each provided with a pair of attachment lugs 66, 68 and 66', 68' or reception of a pair of signs S and S'. Each arm 62, 64 may be duplicates of the post or standard modules 20, 22 and provide open socket ends 70, 72 for reception of respective tenons 74, 76 of closure caps 78, 80. Alternatively, as illustrated in FIG. 4, closed end modules such as 82 may be engaged in sockets 58, 60.

Figure 4:
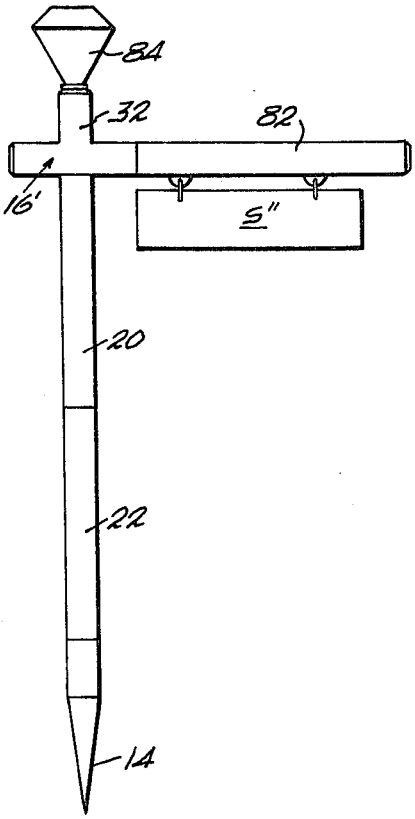
FIG. 4 is a front elevational view of a second modified form of the invention.

FIG. 4, further illustrates a modification which includes an electric lamp 84 mounted atop the top short arm 32'.

A smaller sign S" is suspended from arm 82 which may include a personal family name, business name, etc.

Figure 5:
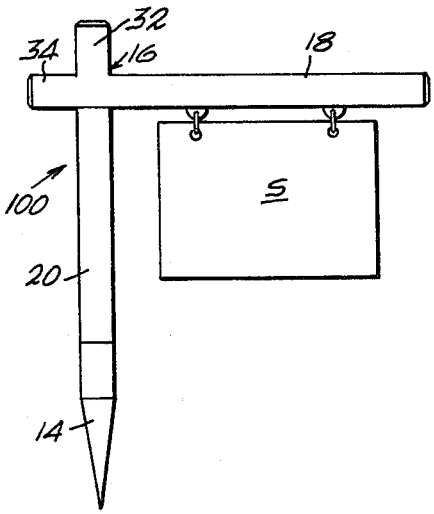
FIGS. 5 and 6 illustrate various modified uses of the structures of FIGS. 1 and 2.

In FIG. 5 the structure 100 is identical with the structure 10 of FIGS. 1 and 2, with one of the modules 20, 22 omitted to provide a shorter special purpose sign such as a directional sign to an Open House, for example.

Figure 6:
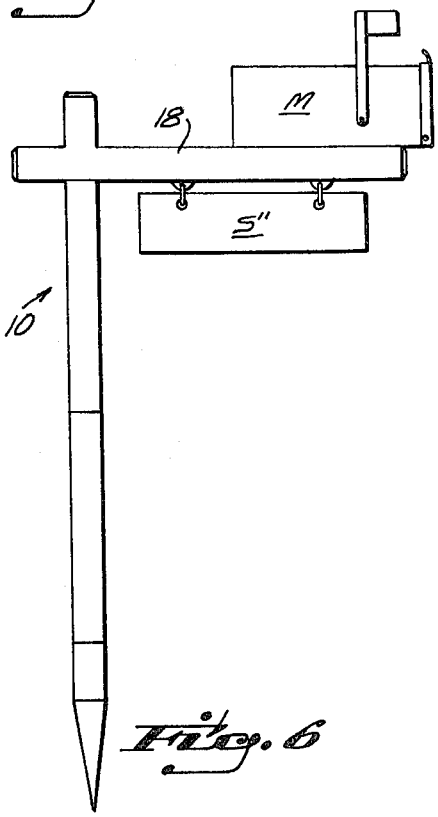

The structure of FIG. 6 is identical with FIGS. 1 and 2, with the addition of a mail box M, mounted on arm 18. A small sign S" as in FIG. 4 is also suspended from arm 18. An electric lamp such as 84 may also be mounted thereatop.

It can therefore be seen that any of the basic sign support structures, above described, may be readily converted from a business use to a personal non-business use. Because of the relatively permanent or long lasting and estehtic qualities of the structure relative to the conventional wooden realtor signs, for example, it is contemplated that, as a good will jesture, the device 10 may be presented to a property purchaser for converted use in the manner disclosed in FIGS. 4 and 6, for example. It should also be noted that an application of a suitable plastic cement to the respective tenons will firmly and permanently secure the modules into a unitary structure.

While several preferred forms of the sign support structure have been herein disclosed, it will be obvious to those skilled in the art that various other changes and modifications can be made therein without departing from the true spirit of the invention as defined in the appended claims.

We claim:

1. A sign support comprising an upright post including a plurality of modules formed of a suitable plastic material and including socket and tenon means to permit a plug-in connection therebetween, the tenon being of reduced dimension to plug into the socket and being contoured to provide a smooth exterior surface between adjacently positioned modules, said plurality of modules including a bottom end spike module including a downwardly projecting pointed end, a top cross arm module including at least one elongated laterally extending arm, and at least one vertically disposed intermediate module of a predetermined length for said plug in connection between said spike and cross arm modules; said elongated laterally extending arm including a first pair of appropriately spaced apart perforated tabs in a downwardly extending relation to and formed integrally with a bottom wall portion thereof tor receive appropriate attachment means to connect a primary sign thereto in a downwardly suspended position, and a generally tubular secondary sign means, cross sectionally sized and configurated for slide-on reception on said elongated arm, and including a longitudinal slot through a bottom wall thereof to provide a clearance for said tabs.

* * * * *